United States Patent [19]

Yamamoto

[11] 4,126,101

[45] Nov. 21, 1978

[54] EXCESS DEVELOPING SOLUTION REMOVING APPARATUS

[75] Inventor: Shunji Yamamoto, Shinshiro, Japan

[73] Assignee: Minolta Camera Kabushiki Kaisha, Osaka, Japan

[21] Appl. No.: 813,184

[22] Filed: Jul. 6, 1977

[30] Foreign Application Priority Data

Jul. 9, 1976 [JP] Japan ..... 51-92219[U]
Jul. 29, 1976 [JP] Japan ..... 51-101790[U]

[51] Int. Cl.[2] ..... G03G 15/10

[52] U.S. Cl. ..... 118/661; 118/652; 118/119

[58] Field of Search ..... 355/10, 3 R; 118/661, 118/652, DIG. 23, 118, 119, 126, 659, 662; 427/15

[56] References Cited

U.S. PATENT DOCUMENTS

| | | | |
|---|---|---|---|
| 3,276,424 | 10/1966 | Marx et al. | 118/661 |
| 3,500,793 | 3/1970 | Bartusek | 118/DIG. 23 |
| 3,596,635 | 8/1971 | Smitzer | 118/661 X |
| 3,689,147 | 9/1972 | Suzuki | 355/10 |
| 3,714,882 | 2/1973 | Schranz et al. | 118/119 |
| 3,733,124 | 5/1973 | Tanaka et al. | 118/647 |
| 3,820,891 | 6/1974 | Kurakawa et al. | 118/652 X |
| 3,841,750 | 10/1974 | Isonaka et al. | 355/3 R |

FOREIGN PATENT DOCUMENTS

| | | | |
|---|---|---|---|
| 2,238,404 | 1/1973 | Fed. Rep. of Germany | 427/15 |

*Primary Examiner*—Werner H. Schroeder
*Assistant Examiner*—Andrew M. Falik

[57] ABSTRACT

An electrophotographic copying apparatus including a wet developing unit of the one-side face developing type which is equipped with a developing unit having an improved excessive developing solution removing device associated with a transfer paper drying device. The excessive developing solution removing device includes a pair of spaced excessive developing solution removing members contacting the latent image bearing surface of the transfer paper fed from the developing unit, and a rotary member rotatably disposed in the vicinity of the removing members and out of contact with the latter for efficient removal of the excessive developing solution from the transfer paper without soiling the paper.

18 Claims, 13 Drawing Figures

EXCESS DEVELOPING SOLUTION REMOVING APPARATUS

The present invention relates to an electrophotographic copying apparatus and more particularly, to an electrophotographic copying apparatus equipped with a developing unit of the wet developing type.

Generally, in an electrophotographic copying apparatus of the wet developing type, for example, an electrophotographic copying apparatus equipped with a so called one-side face developing type developing unit wherein developing solution is supplied only onto one surface, i.e., an image bearing surface of an electrostatic latent image support member such as a transfer paper, photosensitive paper and the like for development, it is necessary that the developing unit be provided with a device for removing surplus or excessive developing solution from the transfer paper, since developing solution adheres to all of the latent image bearing surface of the transfer paper after the development. For an excessive developing solution removing device for the above purpose, there has conventionally been proposed one type in which the transfer paper processed through the developing unit is passed between a pair of rollers rotating in contact with each other under pressure for squeezing the excessive developing solution from the transfer paper. Such a removing device as described above, although most widely employed for removal of the excessive developing solution from sheet-like material such as the transfer paper, has various disadvantages as described below.

Figure 1:
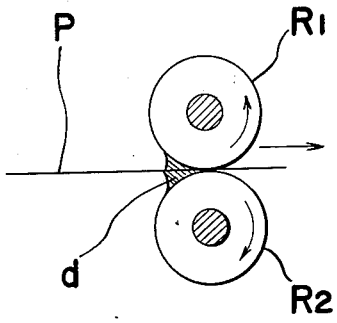
Prior Art FIG. 1 (a)
Figure 1:
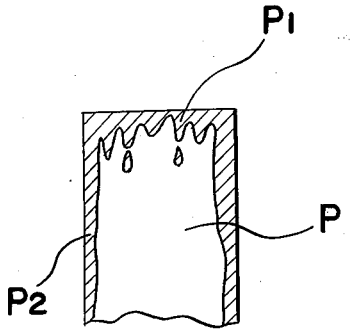
Prior Art FIG. 1 (b)

Referring to FIG. 1(*a*) showing an arrangement of a conventional excessive developing solution removing device, since the developing solution is squeezed out as the transfer paper P is passed through a pair of rollers R1 and R2 after the development, the same developing solution thus removed from the transfer paper tends to be collected in the vicinity of the contact surface between the rollers R1 and R2 as indicated at *d*. The inconvenience as described above has not presented any serious problems in actual use, because if the developing unit is of a type in which the whole transfer paper bearing the latent image thereon is transported through the developing solution, both the latent image bearing surface and the reverse surface of the transfer paper are preliminarily coated to prevent soaking of the developing solution into the transfer paper. In the developing unit of the one-side face developing type as described earlier, however, the reverse surface of the transfer paper is not treated for the prevention of soaking of developing solution into the paper in order to make the transfer paper as similar as possible to a plain paper by the omission of any special treatment of the reverse surface of the transfer paper and simultaneously of limiting wetting by the transfer material to a minimum so as to make it possible to discharge the transfer paper in an almost dried state. Accordingly, the developing solution squeezed out by the rollers R1 and R2 and collected therebetween tends to spread over the reverse surface of the transfer paper P to soaked thereinto, thus giving rise to soiling on the reverse surface especially at opposite ends P1 and side edges P2 of the transfer paper as shown in FIG. 1(*b*).

Figure 2:
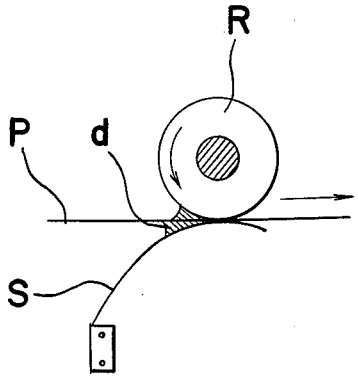
Prior Art FIG. 2

In order to eliminate the disadvantages as described above, there has also conventionally been proposed, for example, in Japanese Patent Application Laid Open to Public SHO-49-5030, laid open Jan. 17, 1974 another developing solution squeezing device as shown in FIG. 2 in which the pair of rollers R1 and R2 in the above known arrangement is replaced by a rotatable roller R and an elastic plate S contacting the roller R. Although the above known squeezing device is effective in that the collection of the developing solution at the squeezing portion is prevented due to dripping of the solution from the contact surface as compared with the former arrangement employing the pair of rollers, there are such disadvantages that the unfixed latent image bearing surface of the transfer paper P is subjected to strong friction with a simultaneous possibility of jamming of the transfer paper, because of the construction in which the fixed elastic plate S contacts the roller R for causing the transfer paper P to be transported with the latent image bearing surface thereof contacting the elastic plate S, and that because the plate S and the roller R contact each other, the developing solution also tends to be collected at the contact surface between the roller R and the plate S as at *d*, thus it being still impossible to completely prevent the soiling of the reverse surface of the transfer paper.

Another known arrangement proposed for a similar purpose includes roller members and a guide member each provided for contacting the image bearing surface of the transfer paper after development to remove the developing solution adhering to the image bearing surface. Such roller members and guide member, however, are each disposed independently, without provision of means for positively contacting the copy paper sheet therewith, and this arrangement is considered to have an extremely low effect for removal of excessive developing solution.

Similarly, there has conventionally been proposed still another arrangement related to an identification card preparing device wherein squeezing means for transfer material for a one-side face developing type wet developing unit is disclosed. In the squeezing means of the above known arrangement which is particularly for processing of hard material such as an identification card, it is essential that the distance between a squeezing roller and a pressing roller should be less than the thickness of the identification card, with the identification card being held between said rollers when passing through the squeezing means, and thus there is a possibility that the developing solution gathering between these rollers soils the reverse surface of the identification card, and the arrangement as described above can not be applied to a thin material such as an ordinary transfer paper.

Accordingly, an essential object of the present invention is to provide an electrophotographic copying apparatus equipped with a developing unit of the wet developing type having an improved excessive developing solution removing device which is capable of positively removing, by a simple construction, the excessive developing solution adhering to an image bearing surface of a transfer paper after developing without soiling the reverse surface of the transfer paper.

Another important object of the present invention is to provide an excessive developing solution removing device of the above described type which includes excessive developing solution removing members and a pressing roller so disposed as not to contact the removing members for causing the transfer paper to positively contact said removing members after development so that the excessive developing solution is removed still more positively.

A further object of the present invention is to provide an excessive developing solution removing device of the above described type in which the developing solution adhering to the excessive developing solution removing members is positively returned to a developing solution tank of the developing unit.

A still further object of the present invention is to provide a developing unit of the wet developing type provided with an excessive developing solution removing device of the above described type.

Another object of the present invention is to provide a drying device which is capable of effectively drying the transfer material after passed through the excessive developing solution removing device of the above described type.

In accomplishing these and other objects, according to a preferred embodiment of the present invention, the electrophotographic copying apparatus includes a wet type developing unit of the one-side face developing type which is equipped with an excessive developing solution removing device associated with a transfer paper or copy paper drying device. The excessive developing solution removing device includes a pair of spaced excessive developing solution removing members contacting a latent image bearing surface of the copy paper sheet fed from the developing unit, and a rotary member rotatably disposed in the vicinity of the excessive developing solution removing members without contacting the latter for efficient removal of the excessive developing solution from the copy paper sheet after the development, while the copy paper sheet after having passed through the above removing device is further fed into the drying device including a belt and roller assembly for further removal of the residual developing solution and drying, by which arrangement the disadvantages inherent in the conventional arrangement such as the soiling of the reverse surface of the copy paper sheet due to spreading of the removed developing solution thereover, damage to the developed image caused by frictional resistance between the image bearing surface of the copy paper sheet and excessive developing solution removing members under strong pressure during removal of the excessive solution and the like are advantageously eliminated.

Figure 3:
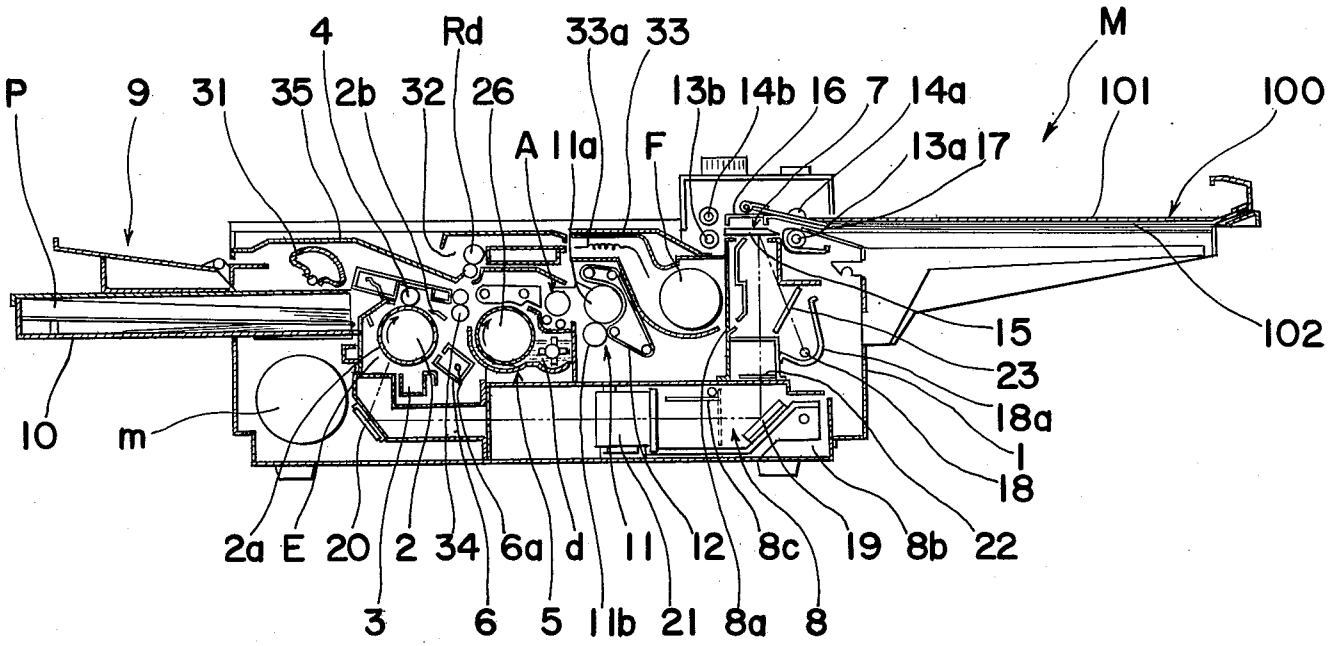
Figure 4:
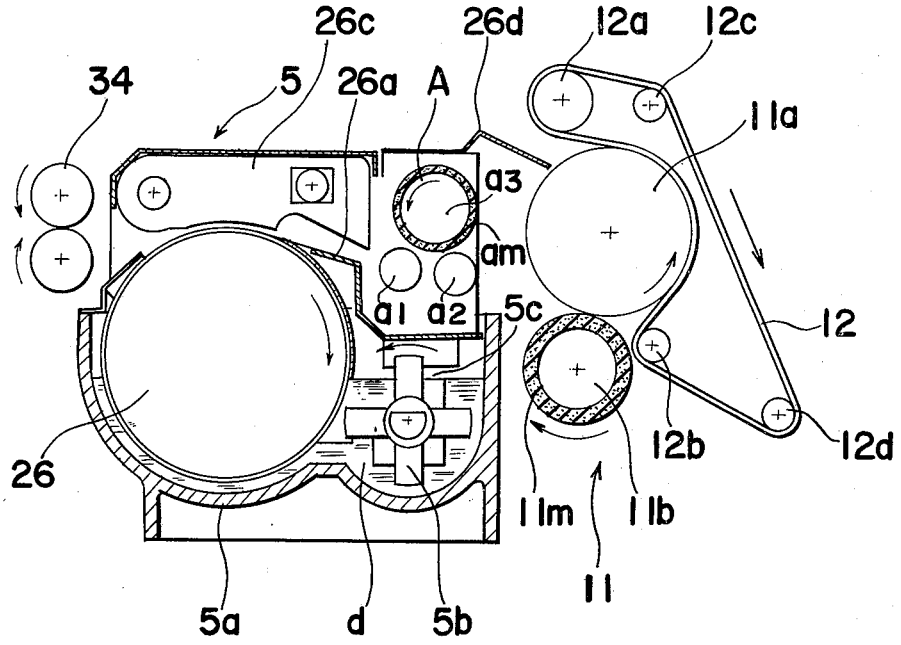
Figure 4:
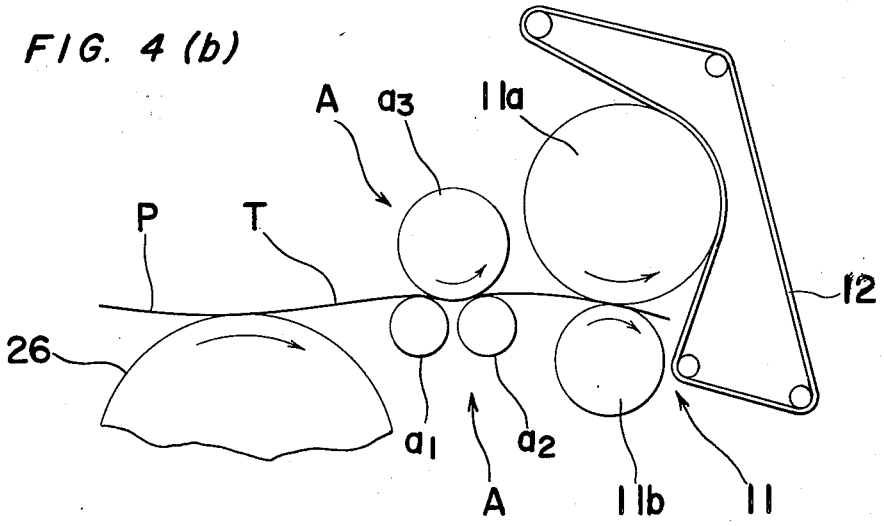
Figure 5:
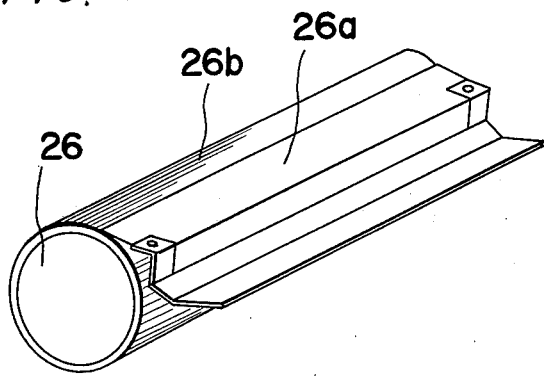
Figure 6:
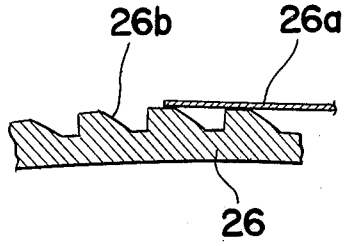
Figure 8:
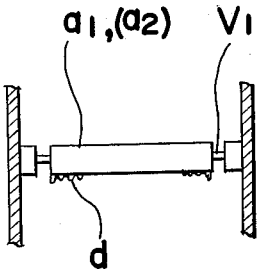
Figure 7:
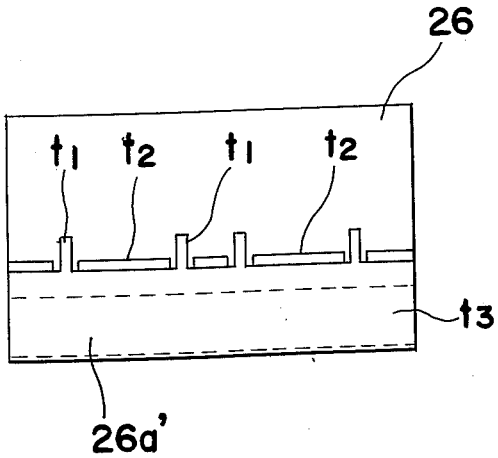
Figure 8:
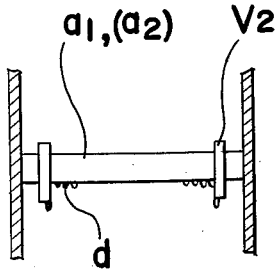
Figure 9:
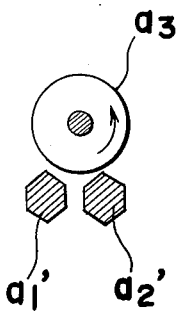
Figure 9:
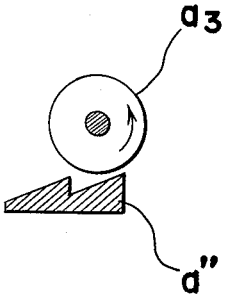

These and other objects and features of the present invention will become apparent from the following description of a preferred embodiment thereof taken together with the accompanying drawings in which;

FIG. 1(*a*) is a schematic side sectional view of a conventional excessive developing solution removing arrangement which has already been referred to, FIG. 1(*b*) is a fragmentary top plan view of a reverse surface of a transfer paper for use in the explanation of disadvantages inherent in the conventional arrangement of FIG. 1(*a*), FIG. 2 is a view similar to FIG. 1(*a*), but particularly shows another conventional excessive developing solution removing arrangement, FIG. 3 is a schematic side sectional view of an electrophotographic copying apparatus incorporating therein an excessive developing solution removing device and drying device according to the present invention, FIG. 4(*a*) is a schematic side sectional view showing, on an enlarged scale, a developing unit and the excessive developing solution removing device associated with a drying device which are employed in the copying apparatus of FIG. 3, FIG. 4(*b*) is a schematic diagram for explaining the functions of the arrangement of FIG. 4(*a*), FIG. 5 is a perspective view of a developing roller and separating plate employed in the arrangement of FIG. 4(*a*), FIG. 6 is a fragmentary cross sectional view showing, on an enlarged scale, construction of the surface of the developing roller with respect to the separating plate employed in the arrangement of FIG. 5, FIG. 7 is a schematic top plan view showing a modification of the arrangement of FIG. 5, FIGS. 8(*a*) and 8(*b*) are fragmentary side views showing constructions of an excessive developing solution removing member employed in the excessive developing solution removing device of FIG. 4(*a*), FIG. 9(*a*) is a side sectional view showing, on an enlarged scale, an arrangement of the excessive developing solution removing members and a feeding roller employed in the excessive developing solution removing device of FIG. 4(*a*), and FIG. 9(*b*) is a similar view to FIG. 9(*a*), but particularly shows a modification thereof.

Before the description of the present invention proceeds, it is to be noted that like parts are designated by like reference numerals the several views of the attached drawings.

Referring now to the drawings, there is shown in FIG. 3 a transfer type electrophotographic copying apparatus M equipped with a developing unit 5 having an excess developing solution removing device A according to one preferred embodiment of the present invention. The copying apparatus M generally includes an apparatus housing 1 of cubic box-like configuration defined by side walls, and a photosensitive member or photoreceptor drum 2 of a known construction having a photoconductive photoreceptor surface 2*a* provided on the outer periphery thereof and rotatably disposed at approximately the central portion of the housing 1 for rotation in the direction of the arrow to cause the photoreceptor surface 2*a* sequentially to pass various processing stations disposed therearound for image formation, such as a charging station with a corona charger 3, an exposure station E, a transfer station having a transfer roller 4, the developing station including the developing unit 5 of the wet type which is associated with the excessive developing solution removing device A directly related to the present invention, a charge erasing station 6 provided with an eraser lamp 6*a*, etc. Further included in the copying apparatus M are a transportation unit 7 for an original (not shown) to be copied, an optical system 8 which includes a light shielding case 8*a* extending upwardly from a base frame 8*b* to form an approximately L-shaped light passage between the original transportation unit 7 and the exposure station E, a transfer material or copy paper feeding device 9 having a tray or cassette 10 for holding therein a supply of copy paper sheets P, a copy paper feeding roller 31 having a sector shaped cross section, clutch means (not shown), etc., a driving motor *m* and a copy paper transportation passage leading from the copy paper feeding device 9 to an upper surface of the apparatus housing 1 through the upper portions of the photoreceptor drum 2 and developing unit 5 via the excessive developing solution removing device A and a drying device 11 including squeezing rollers 11*a* and 11*b* and developing solution absorbing belt 12.

The copying apparatus M is capable of copying a thick original such as a book when used with a reciprocatingly movable platform 100 including a transparent plate 102, for example, of glass material for placing the thick original to be copied (not shown) thereon and a cover plate 101 for the original, which platform is adapted to reciprocate horizontally by rotation of juxtaposed roller pairs 14*a* and 13*a*, and 14*b* and 13*b*, and the apparatus is also capable of copying a thin original in sheet form, with the reciprocatingly movable platform 100 removed from the apparatus housing 1. The original transportation unit 7 includes the original transportation rollers 13*a* and 13*b* rotatably disposed in parallel and in spaced relation to each other and the corresponding rollers 14*a* and 14*b* respectively contacting the rollers 13*a* and 13*b* under pressure for being rotated by the rotation of the rollers 13*a* and 13*b*. In the space between the rollers 13*a* and 14*a*, and 13*b* and 14*b*, a transparent plate 15, for example, of glass material is supported by frames (not shown) of the apparatus housing 1 for receiving thereon the original to be copied inserted into the apparatus M through an inlet opening 17, and a guide plate 16 is disposed adjacent to and above the transparent plate 15. The optical system 8 for the image formation mainly includes, in its L-shaped light passage composed of the light shielding case 8*a* and base frame 8*b*, a light source, for example, an exposure lamp or illuminating lamp 18 for illuminating the original on the transparent plate 15, reflecting mirrors 19 and 20 suitably inclined to direct the light rays from the original toward the photoreceptor surface 2*a*, and an image forming lens assembly 21 disposed between the reflecting mirrors 19 and 20, with a shutter member 8*c* being pivotally disposed between the mirror 19 and the lens assembly 21 so as to be pivoted to a position shown by a dotted line when the power supply for the apparatus M is turned off. The illuminating lamp 18 which is accommodated in a reflecting shade 18*a* having an elliptical surface is disposed below and adjacent to the copy paper transportation unit 7 in the light shielding case 8*a*, while the reflecting mirrors 19 and 20 and the lens assembly 21 are housed in the base frame 8*b*. Additionally, at the junction between the light shielding case 8*a* and the base frame 8*b*, a dust proof plate 22, for example, of glass material is disposed, while in the light shielding case 8*a* at a position adjacent to the reflecting shade 18*a*, a correction plate 23, for example, of heat-absorbing glass material is pivotally disposed for correcting difference in the light paths caused by a change-over from copying a thin original to copying a thick original and also for correcting the intensity of illumination of the surface of the original by the illuminating lamp 18.

By the above arrangement, for copying a thin sheet original, the reciprocatingly movable platform 100 for the thick original is removed, and the original inserted into the apparatus M through the inlet opening 17 is passed between the transparent plate 15 and the guide plate 16 upon rotation of the original transportation rollers 13*a* and 13*b*, and the surface of the original is illuminated by the lamp 18 from under the lower surface of the plate 15 for directing light rays reflected by the original onto the photoreceptor surface 2*a* through the reflecting mirror 19, lens assembly 21 and reflecting mirror 22 to form an electrostatic latent image of the original on the photoreceptor surface 2*a*.

On the other hand, the copy paper sheets P stacked up on the tray 10 of the copy paper feeding device 9 are fed by the feeding roller 31 one by one in synchronization with the insertion and transportation of the original into the apparatus housing 1, and the latent image of the original formed on the photoreceptor surface 2*a* is transferred at the transfer station onto an insulation-treated surface of the copy paper sheet P by the transfer roller 4. The copy paper sheet P bearing thereon the latent image of the original thus transferred is separated from the photoreceptor surface 2*a* by a separating claw 2*b* disposed in contact with the photoreceptor surface 2*a* and is further fed to the developing unit 5 by copy paper transportation rollers 34.

Referring also to FIGS. 4(*a*) to 6, the developing unit 5 disposed at the right hand side of the photoreceptor drum 2 in FIG. 3 includes a developing roller 26 rotatably disposed for clockwise rotation in a developing tank 5*a* which is filled with developing solution *d* containing toner particles therein. The developing roller 26 has many shallow grooves 26*b* (FIGS. 5 and 6) formed in the outer periphery of the roller 26 in a direction parallel to the axis of said roller 26 for assisting in picking up of the developing solution thereonto, while a press plate or guide 26*c* (FIG. 4(*a*)) is disposed above the developing roller 26 with a slight gap being provided therebetween. Adjacent to the developing roller 26 and below the press plate 26*c*, there is disposed a blade member or separating plate 26*a*, for example, of synthetic resin such as Mylar or of metallic material which lightly contacts the outer periphery of the developing roller 26 and is inclined to a radius of the roller 26 in the direction of rotation of the roller 26. The separating plate 26*a* has a length at least equal to the axial length of the developing roller 26 and is suitably secured to the developing tank 5*a* in a direction parallel to the developing roller 26. The developing unit 5 further includes a rotary vane 5*b*( FIG. 4(*b*)) rotatably disposed in the developing tank 5 in a position adjacent to the developing roller 26 for efficient stirring of the developing solution *d* contained in the tank 5*a*. As the roller 26 rotates in the tank 5, the developing solution *d* is picked up onto the surface of the roller 26 to form a layer of developing solution on the outer periphery of the roller 26, and the latent image formed on the copy paper sheet P which is transported with its image carrying surface directed downward is developed into a visible image upon contact of the developing solution layer on the roller 26 with the latent image through adhesion of toner in the developing solution *d* onto the latent image. The above described separating plate 26*a*, for example, of Mylar can be a single plate member held in contact with the outer periphery of the developing roller 26 as shown in FIGS. 5 and 6. In this case, the developing solution *d* from the roller 26 flows onto the plate 26*a*, and if the separating member 26*a* is made electrically conductive, an electrode effect can be obtained during the development of the copy paper sheet to increase the developing density.

Referring to FIG. 7, there is shown a modification of the above described separating plate 26*a*. The modified blade member or separating plate 26*a'* has a plurality of projections $t_1$ which lightly contact the copy paper feeding surface at the top portion of the periphery of the developing roller 26 for facilitating the separation of the copy paper from the roller 26, while downwardly extending portions $t_2$ which are shorter in length than the projections $t_1$ are formed on the plate 26*a'* between the projections $t_1$ as shown. Accordingly, the developing solution picked up to the outer periphery of the developing roller 26 to form the layer thereon in the manner as described earlier drips directly through the portions $t_2$ between the projections $t_1$ as the roller 26 rotates, without forming any liquid pool or liquid flow on the plate 26a', while the copy paper sheet is positively separated from the roller 26 by the tips of the projections $t_1$ contacting the outer periphery of said roller 26. Additionally, if at least the projections $t_1$ of the separating plate 26a' are formed of elastic material, the separation of the copy paper sheet is made still more positive, since the projections $t_1$ are held in close contact with the outer periphery of the roller 26 even if the roller 26 has a certain eccentricity in its rotation. Furthermore, if the separating plate 26a' is formed by electrically conductive material, an electrode effect can be obtained in the development of the copy paper sheet to increase developing density as with the separating plate 26a of FIG. 5. In this case, it is preferable that the length of a guide portion $t_3$ of the plate 26a' in the direction of advance of the copy paper sheet be longer than that of the projections $t_1$. In the above arrangement, since the developing solution is caused to drip between the projections $t_1$ for eliminating gathering of liquid on the separating plate 26a', the disadvantages in the conventional arrangements such as soiling of the reverse surface of the copy paper sheet are advantageously prevented.

Referring back to FIGS. 3 to 4(*b*), the copy paper sheet the latent image of which is thus developed is led into an excessive developing solution removing device A described below over the separating member 26a (FIGS. 5 and 6) which also serves as a guide member for the copy paper sheet P.

Still referring to FIGS. 4(*a*) and 4(*b*), the excessive developing solution removing device A disposed for removal of excessive developing solution adhering to the image carrying surface of the copy paper sheet P in the path T of the copy paper sheet P between the developing unit 5 and the squeezing rollers 11a and 11b of the drying device 11 includes a pair of spaced excessive developing solution removing members or rods $a_1$ and $a_2$ fixedly disposed below the copy paper sheet path T to contact the image bearing surface of the copy paper sheet, and a feeding roller $a_3$ rotatably disposed above the rods $a_1$ and $a_2$ to contact the reverse surface of the copy paper sheet without contacting the rods $a_1$ and $a_2$. In the excessive developing solution removing device A as described above, the excessive developing solution removing rods $a_1$ and $a_2$ and the roller $a_3$ are positioned in the relation as described below. As is seen from FIG. 4(*b*), the removing rods $a_1$ and $a_2$ are cylindrical rod or roller members disposed in a direction approximately at right angles to the direction of advance of the copy paper sheet P and parallel to the copy paper passage T, and are secured at opposite ends thereof to side walls (not shown) of the developing tank 5a in positions above the separating plate 26a. The highest points of the rods $a_1$ and $a_2$ are located above a line which is tangential to the developing roller 26 in the direction of copy paper transportation, while the lowest point of the roller $a_3$ is positioned intermediate the rods $a_1$ and $a_2$ so as to be located below the highest points of said rods $a_1$ and $a_2$, so that the copy paper path T has approximately an M-shape between the roller $a_3$ and the rods $a_1$ and $a_2$ within the excessive developing solution removing device A. It should be noted here that the rotational speed of the feeding roller $a_3$ at this time is set so as to be the same as or faster than the transportation speed of the copy paper sheet P. By the presence of the M-shaped passage, the image formed on the lower surface of the copy paper sheet is caused to contact the rods $a_2$ and $a_2$ over a large contact area which is particularly effective for removing the excessive developing solution in the excessive developing solution removing device A of the invention which is not provided with a separate forcible contacting member. Moreover, since the rods $a_1$ and $a_2$ are not in contact with the feeding roller $a_3$, removed developing solution is not gathered therebetween, and any developing solution temporarily collected between the roller $a_3$ and the rods $a_1$ and $a_2$ during passing of the copy paper sheet does not spread over the reverse surface of the copy paper sheet to soil this surface, but immediately drips into a developing solution receiving portion 5c of the tank 5a to be recollected, whereby the copy paper sheet transported from the subsequent copying operation is kept from being soiled.

Referring also to FIGS. 8(*a*) to 9(*b*), each of the excessive developing solution removing rods $a_1$ and $a_2$ has reduced diameter portions or grooves V1, or large diameter portions or projections V2 adjacent to opposite ends thereof (FIGS. 8(*a*) and 8(*b*)) for causing the removed developing solution *d* to drip into the tank 5a at the portions V1 or V2 without being led to the side walls. It should be noted here that the removing rods $a_1$ and $a_2$ need not necessarily have a cylindrical configuration, but may be replaced by a pair of bars $a_1'$ and $a_2'$ having a hexagonal cross section (FIG. 9(*a*)) which form the M-shaped passage as mentioned earlier or by a plate-like member $a''$ having a saw tooth shaped cross section (FIG. 9(*b*)). In the latter case, at least the surface of the member $a''$ which contains a linear portion contacting the copy paper sheet is arranged to be raised in the direction of transport of the copy paper sheet with the linear portion positioned at its top. In the above embodiment, it is preferable that the excessive developing solution removing rods $a_1$ and $a_2$ be formed of electrically conductive material suitably grounded to prevent undesirable phenomena such as fogging due an electrostatic charge on the image formed surface of the copy paper sheet, and that the feeding roller $a_1$ should have, at least at its surface, suitable developing solution absorbing material *am* (FIG. 4(*a*)) so that any developing solution spread onto the reverse surface of the copy paper sheet is immediately absorbed thereby to prevent soiling the reverse surfact of the copy paper.

Referring back to FIGS. 3 to 4(*b*), the copy paper sheet having the excessive developing solution adhering to its image carrying surface removed by the excessive developing solution removing device A is subsequently fed into the drying device 11 including the squeezing rollers 11a and 11b, i.e., the lower roller or absorbing roller 11b having developing solution absorbing material 11m on the outer periphery thereof and the upper roller or copy paper reversing roller 11a rotating in contact with the roller 11b, and the endless absorbing belt 12 movably supported by a plurality of rollers, for example, rollers 12a, 12b, 12c and 12d, and is subsequently discharged onto the discharge tray 35 at the upper portion of the apparatus housing 1 by a guide plate 26d above the rotary member $a_3$ and the discharge rollers R*d* (FIG. 3). The roller 11a is pressed against and in close contact with the portion of the belt 12 between the rollers 12a and 12b to give sufficient tension to the belt 12 and to form a reversing passage for the copy paper sheet P thereat. When the copy paper sheet P is transported between the roller 11a and the belt 12, the direction of advance of the sheet is reversed so that it is discharged onto the discharge tray 35 (FIG. 3) with its image bearing surface directed upward. Meanwhile, the warm air around the illuminating lamp 18 directed toward the copy paper discharge opening 32 (FIG. 3) by a fan F rotatably disposed in a duct 33 in the apparatus houding 1 is also brought into contact with the belt 12 in the vicinity of the roller 12*a* to dry the belt 12 for preventing deterioration of the developing solution absorbing capability of said belt 12. It should be noted here that the belt 12 is not limited to one having a developing solution absorbing capability as described above, but it can be replaced by other members which are less likely to be soiled by the toner, in which latter case, the image on the copy paper sheet is not soiled by such members. The inconvenience due to the removed developing solution which tends to gather at the contacting portion between the rollers 11*a* and 11*b* is eliminated by using the upper roller 11*a* also for part of the drying device 11 as described above, since the developing solution collected between the rollers 11*a* and 11*b* is absorbed by the belt 12 and the developing solution absorbing material 11*m* on the outer periphery of the lower roller 11*b* before the copy paper sheet P passes therethrough. Furthermore, since the drying device 11 is constituted by the belt 12 and the upper roller 11*a*, the between time between the developing solution absorbing material of the belt 12 and the copy paper sheet are in contact is increased, and thus not only is the absorbing effect improved, but no separate space exclusively for the drying section is required. For improving drying of the belt 12 and the copy paper sheet P still more, a heating element 33*a* may further be disposed within the duct 33 or within the upper roller 11*a*. In the drying device 11 of the foregoing embodiment, the copy paper sheet fed between the lower roller or absorbing roller 11*b* and the upper roller or reversing roller 11*a* is wet only to a slight extent at its surface since the excessive developing solution is removed therefrom at the removing device A as described above, and moreover, due to the fact that the absorbing roller 11*b* engages the image bearing surface of the copy paper sheet, the disadvantages of the conventional squeezing rollers such as gathering of the removed developing solution at the contact surface between two rollers, consequent spreading of such developing solution onto the reverse surface of the copy paper sheet, and the like are eliminated. It is preferable, however, to form fine grooves (not shown) in the outer periphery of the reversing roller 11*a* in a direction so as to intersect with a rotating shaft (not shown) of the roller 11*a* for preventing the possibility that any developing solution which happens to have adhered to the reverse surface of the copy paper sheet will spread due to pressure acting between the rollers 11*a* and 11*b* to increase the size of the soiled portion. The fine grooves as described above are also effective for preventing dispersion of the developing solution over the reverse surface of the copy paper, in cases where the leading edge of the copy paper sheet is wet when introduced onto the developing roller 26 of the developing unit 5.

It should be noted here that the drying device 11 as described above may be replaced by various other drying devices of the heating type, blowing type and the like for drying the copy paper sheet which has passed through the excessive developing solution removing device A.

As is clear from the foregoing description, in the electrophotographic copying apparatus according to the present invention, the wet type developing unit of the one-side face developing type is associated with the excessive developing solution removing device which includes the excessive developing solution removing member contacting the image bearing surface of the copy paper sheet, and the rotary member is rotatably disposed in the vicinity of the excessive developing solution removing member without contacting the latter. Accordingly, the disadvantages in the conventional arrangements such as the soiling of the reverse surface of the copy paper sheet due to spreading of the removed developing solution thereover, damage to the developed image taking place due to frictional resistance between the image bearing surface of the copy paper sheet and excessive developing solution removing member during removal of the excessive developing solution and the like are effectively prevented.

Furthermore, since the excessive developing solution removing member has, on the side contacting the image bearing surface of a copy paper sheet, the surface intersecting the advancing direction of the copy paper sheet and including a straight line parallel to the advancing direction so as to raise the path of the copy paper sheet to said straight line as the highest point, the excessive developing solution is positively removed without a possibility of copy paper jamming. Additionally, by the arrangement in which the excessive developing solution removing member contacts the copy paper sheet above the level of the path of advance of the copy paper sheet, the contact area between the removing member and copy paper sheet is advantageously increased to remove still more developing solution, while positive removal of the developing solution can be effected without provision of any other forcible contacting means through the construction wherein the rotary member is positioned between the two excessive developing solution removing members to form the M-shaped passage for the copy paper sheet thereat. Moreover, since the outer periphery of the rotary member is a liquid absorbing material, any developing solution spread over the reverse surface of the copy paper is rapidly absorbed to positively prevent soiling of the reverse surface of the copy paper sheet. Meanwhile, the provision of the convex or concave portions (the reduced diameter portions V1 or large diameter portions V2 of FIGS. 8(*a*) and 8(*b*)) on the excessive developing solution removing members makes it possible to positively recollect the remove developing solution effectively. In addition, by forming the excessive developing solution removing members of electrically conductive material which is suitably grounded, inconveniences such as fogging due to electrical charge on a copy paper sheet or the like are advantageously prevented.

It should be noted that in the foregoing embodiment, although the present invention is mainly described with reference to an electrophotographic copying apparatus of the electrostatic latent image transfer type having a wet developing unit of the roller developing type, the excessive developing solution removing device and the drying device directly related to the present invention are not limited in their application to the copying apparatus of the above described type alone, but may be readily applicable to any other copying apparatuses of the wet developing type, such as a FAX system copying apparatus of the wet developing type.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A developing unit of the wet developing type employing developing solution for use in an electrophotographic copying apparatus which includes a developing roller member rotating in a developing tank, with part of said developing roller member immersed in the developing solution in said developing tank, and means for removing excess developing solution adhering to the surface of copying paper developed while passing said developing roller member, said excess developing solution removing means comprising, at least two developing solution removing members disposed in a path of the copying paper so as to contact an image bearing surface of the copying paper after it has passed said developing roller member, means for lightly depressing the copying paper toward said developing solution removing members and positioned between said two developing solution removing members, said depressing means for the copying paper not contacting said developing solution removing members, with the copying paper being transported between said developing solution removing members and said copying paper depressing means in an approximately M-shaped path, said developing solution removing members being disposed in a direction at right angles to the transporting direction of the copying paper and having a linear portion with a length sufficient to contact the entire surface of the copying paper and being so constructed as to prevent the developing solution removed by contact of said developing solution removing members with the copying paper after the developing from spreading onto the reverse surface of the copying paper.

2. A developing unit as claimed in claim 1, wherein said copying paper depressing means is a roller member rotatably disposed above said two developing solution removing members, said roller member having on its surface a material which absorbs the developing solution.

3. A developing unit as claimed in claim 1, wherein said developing solution removing members are roller members secured to the inside of the walls of said developing tank.

4. A developing unit as claimed in claim 1 wherein said developing solution removing members are rod members having a polygonal cross section secured to inside of the walls of said developing tank.

5. A developing unit as claimed in claim 1, wherein said developing solution removing members are a plate member having a saw tooth shaped cross section having at least two top portions.

6. A developing unit as claimed in claim 1, wherein said developing solution removing members have projections formed at the end portions thereof for causing the removed developing solution to drip into said developing tank.

7. A developing unit as claimed in claim 1, wherein said developing solution removing members have grooves at end portions thereof for causing the removed developing solution to drip into said developing tank.

8. A developing unit of the wet developing type employing developing solution for use in an electrophotographic copying apparatus which includes a developing roller member rotating in a developing tank, with part of said developing roller member immersed in the developing solution in said developing tank, and means for removing excess developing solution adhering to the surface of copying paper developed by passing said developing roller member, said excess developing solution removing means comprising, two developing solution removing rollers disposed in the path of transportation of the copying paper so as to contact an image bearing surface of the copying paper after it has passed said developing roller member, and a copying paper depressing roller disposed above said two developing solution removing rollers in spaced relation to the latter and rotating in a direction for moving the copying paper in the direction of transport thereof, said copying paper being transported between said developing solution removing rollers and said copying paper depressing roller in an approximately M-shaped path, said copying paper depressing roller and developing solution removing rollers being disposed in a direction at right angles to the direction of transportation of the copying paper and having a length sufficient to contact the entire surface of the copying paper, said developing solution removing rollers being so constructed as to prevent the developing solution removed by contact thereof with the copying paper from spreading onto a reverse surface of the copying paper.

9. A developing unit as claimed in claim 8, wherein said copying paper depressing roller has the surface thereof of formed with material for absorbing the developing solution.

10. A developing unit as claimed in claim 8, further comprising copying paper drying means into which the transfer paper which has passed said excessive developing solution removing means is introduced initially with its image bearing surface directed downward so as to be reversed by a reversing roller of said drying means for being discharged with the image bearing surface thereof directed upward through the upper portion of said developing unit.

11. A developing unit as claimed in claim 10, wherein said reversing roller has on its surface a material for absorbing the developing solution.

12. A developing unit of the wet developing type employing developing solution for use in an electrophotographic copying apparatus and which includes developing means for supplying the developing solution only onto an electrostatic latent image bearing surface of a copying paper, and means for removing excess developing solution adhering to the surface of copying paper developed by passing said developing means, said excess developing solution removing means comprising;

at least two developing solution removing members disposed in the path of the copying paper for contacting the image bearing surface of the copying paper after the copying paper has passed said developing means, and means for lightly depressing the copying paper toward said developing solution remvoing members from above said means being between two developing solution removing members, said depressing means being spaced from said developing solution removing members, and defining with said developing solution removing members an approximately M-shaped path along which the copying paper is transported, said developing solution removing members being disposed in a direction at right angles to the direction of transporting of the copying paper and having a structure for preventing the developing solution removed by contact of said developing solution removing members with the copying paper from spreading onto the reverse surface of the copying paper.

13. A developing unit as claimed in claim 12, wherein said copying paper depressing means is a roller member rotatably disposed above said two developing solution removing members, said roller member having on its surface a material which absorbs the developing solution.

14. A developing unit as claimed in claim 12, wherein said developing solution removing members are roller members secured to the inside of the walls of said developing tank.

15. A developing unit as claimed in claim 12, wherein said developing solution removing members are rod members having a polygonal cross section secured to the inside of the walls of said developing tank.

16. A developing unit as claimed in claim 12, wherein said developing solution removing members are a plate member having a saw tooth shaped cross section having at least two top portions.

17. A developing unit as claimed in claim 12, wherein said developing solution remvoing members have projections formed at the end portions thereof for causing the removed developing solution to drip into said developing tank.

18. A developing unit as claimed in claim 12, wherein said developing solution removing members have grooves at end portions thereof for causing the removed developing solution to drip into said developing tank.

* * * * *